US009243312B2

(12) United States Patent
Nagaishi et al.

(10) Patent No.: US 9,243,312 B2
(45) Date of Patent: Jan. 26, 2016

(54) ALUMINUM ALLOY CASTING AND PRODUCTION METHOD THEREOF

(75) Inventors: Yusuke Nagaishi, Sagamihara (JP); Shigeyuki Nakagawa, Yokosuka (JP); Koji Itakura, Fujisawa (JP); Haruyasu Katto, Anjo (JP); Satoru Suzuki, Fuji (JP)

(73) Assignees: NISSAN MOTOR CO., LTD., Yokohama-shi (JP); NIPPON LIGHT METAL COMPANY, LTD., Tokyo (JP)

( * ) Notice: Subject to any disclaimer, the term of this patent is extended or adjusted under 35 U.S.C. 154(b) by 983 days.

(21) Appl. No.: 13/391,445

(22) PCT Filed: Jul. 27, 2010

(86) PCT No.: PCT/JP2010/004756
§ 371 (c)(1), (2), (4) Date: Feb. 21, 2012

(87) PCT Pub. No.: WO2011/030500
PCT Pub. Date: Mar. 17, 2011

(65) Prior Publication Data

US 2012/0148444 A1 Jun. 14, 2012

(30) Foreign Application Priority Data

Sep. 10, 2009 (JP) ..... 2009-209590

(51) Int. Cl.

| | |
|---|---|
| ***C22C 21/02*** | (2006.01) |
| ***C22C 21/04*** | (2006.01) |
| ***B22D 21/04*** | (2006.01) |
| ***B22D 17/00*** | (2006.01) |
| *B22D 21/00* | (2006.01) |

(52) U.S. Cl.
CPC ..... *C22C 21/02* (2013.01); *B22D 17/00* (2013.01); *C22C 21/04* (2013.01); *B22D 21/007* (2013.01)

(58) Field of Classification Search
CPC ..... C22C 21/02; C22C 21/04; B22D 17/00; B22D 21/007
See application file for complete search history.

(56) References Cited

U.S. PATENT DOCUMENTS

| | | | |
|---|---|---|---|
| 6,364,970 | B1 | 4/2002 | Hielscher et al. |
| 6,921,512 | B2 | 7/2005 | Doty |

(Continued)

FOREIGN PATENT DOCUMENTS

| | | | |
|---|---|---|---|
| CN | 1809647 | A | 7/2006 |
| CN | 101338395 | A | 1/2009 |

(Continued)

OTHER PUBLICATIONS

Jis H 0001, "Aluminium, magnesium and their alloys—Temper designation", Japanese Industrial Standard, (1998).

(Continued)

*Primary Examiner* — George Wyszomierski
*Assistant Examiner* — Janelle Morillo
(74) *Attorney, Agent, or Firm* — Foley & Lardner LLP

(57) ABSTRACT

There is provided an aluminum alloy casting consisting essentially of 7.0 to 11.5 mass % of Si, 0.9 to 4.0 mass % of Mg, 0.1 to 0.65 mass % of Fe, 0.1 to 0.8 mass % of Mn and the balance being Al and unavoidable impurities, or consisting essentially of 7.0 to 11.5 mass % of Si, 0.9 to 4.0 mass % of Mg, 0.1 to 0.65 mass % of Fe, 0.1 to 0.8 mass % of Mn, 0.3 to 1.0 mass % of Cu and the balance being Al and unavoidable impurities, and containing eutectic Si grains having an aspect ratio of 2.0 or smaller and an average grain size of 1.0 micrometer or smaller. There is also provided an automotive part formed with the aluminum alloy casting and a production method of the aluminum alloy casting.

8 Claims, 2 Drawing Sheets

(56) References Cited

U.S. PATENT DOCUMENTS

| | | | | |
|---|---|---|---|---|
| 2006/0118269 | A1* | 6/2006 | Odashima | B22D 11/003 164/452 |
| 2009/0010799 | A1 | 1/2009 | Souda et al. | |
| 2010/0006192 | A1* | 1/2010 | Okamoto | B21J 5/00 148/691 |

FOREIGN PATENT DOCUMENTS

| | | | |
|---|---|---|---|
| CN | 101522935 | A | 9/2009 |
| DE | 100 02 021 | A1 | 4/2001 |
| EP | 0 687 742 | A1 | 12/1995 |
| EP | 0 796 926 | A1 | 9/1997 |
| JP | 08134578 | A * | 5/1996 |
| JP | 3255560 | B2 | 2/2002 |

OTHER PUBLICATIONS

Jis Z 2201, "Test pieces for tensile test for metallic materials", Japanese Industrial Standard, (1998).

Jis Z 2241, "Method of tensile test for metallic materials", Japanese Industrial Standard, (1998).

* cited by examiner

ALUMINUM ALLOY CASTING AND PRODUCTION METHOD THEREOF

TECHNICAL FIELD

The present invention relates to an aluminum alloy casting and a production method thereof. More particularly, the present invention relates to an aluminum alloy casting having a predetermined alloy element composition and containing eutectic Si grains of predetermined aspect ratio and size, an automotive part using the aluminum alloy casting, and a method of producing the aluminum alloy casting.

BACKGROUND ART

In general, aluminum alloys feature high shape flexibility, high dimensional accuracy, high productivity and the capability of being formed into a small thickness and enabling a one-piece part design and thus have recently been put to a wide range of uses such as automotive parts, e.g., body flame parts, door inner parts, suspension parts etc. For the uses of aluminum alloys in automotive parts, it is proposed to add a eutectic modifying element such as Sr or Sb to the aluminum alloy in order to modify the eutectic Si structure of the aluminum alloy and thereby improve the mechanical properties of the aluminum alloy.

CITATION LIST

Patent Literature

PTL 1: Japanese Patent No. 3255560

SUMMARY OF INVENTION

Technical Problem

However, there is a tendency that the addition of such a eutectic modifying element causes an increase in the amount of gas entering into the aluminum alloy. This results in a deterioration of the mechanical properties of the aluminum alloy due to the development of porosity in the aluminum alloy.

It is accordingly an object of the present invention to provide an aluminum alloy casting capable of achieving excellent mechanical properties without adding thereto an expensive eutectic modifying element such as Sr, Sb, Ca, Na etc. It is also an object of the present invention to provide an automotive part using the aluminum alloy casting and a method of producing the aluminum alloy casting.

Solution to Problem

As a result of extensive researches, the present inventors have found that it is possible to produce an aluminum alloy casting in which eutectic Si grains has a predetermined aspect ratio and size so that the aluminum alloy casting can achieve excellent mechanical properties by casting a molten aluminum alloy of predetermined alloy element composition under predetermined conditions. The present invention is based on this finding.

According to a first aspect of the present invention, there is provided an aluminum alloy casting consisting essentially of 7.0 to 11.5 mass % of Si, 0.9 to 4.0 mass % of Mg, 0.1 to 0.65 mass % of Fe, 0.1 to 0.8 mass % of Mn and the balance being Al and unavoidable impurities and containing eutectic Si grains having an aspect ratio of 2.0 or smaller and an average grain size of 1.0 micrometer or smaller.

According to a second aspect of the present invention, there is provided an aluminum alloy casting consisting essentially of 7.0 to 11.5 mass % of Si, 0.9 to 4.0 mass % of Mg, 0.1 to 0.65 mass % of Fe, 0.1 to 0.8 mass % of Mn, 0.3 to 1.0 mass % of Cu and the balance being Al and unavoidable impurities and containing eutectic Si grains having an aspect ratio of 2.0 or smaller and an average grain size of 1.0 micrometer or smaller.

According to a third aspect of the present invention, there is provided an automotive part using the aluminum alloy casting.

According to a fourth aspect of the present invention, there is provided a method of producing the aluminum alloy casting, comprising: preparing a molten aluminum alloy consisting essentially of 7.0 to 11.5 mass % of Si, 0.9 to 4.0 mass % of Mg, 0.1 to 0.65 mass % of Fe, 0.1 to 0.8 mass % of Mn and the balance being Al and unavoidable impurities, or consisting essentially of 7.0 to 11.5 mass % of Si, 0.9 to 4.0 mass % of Mg, 0.1 to 0.65 mass % of Fe, 0.1 to 0.8 mass % of Mn, 0.3 to 1.0 mass % of Cu and the balance being Al and unavoidable impurities; and injecting the molten aluminum alloy into a casting mold to thereby cast the molten aluminum alloy under the condition that an average flow rate of the molten aluminum alloy in the casting mold is 12 m/s or higher.

DESCRIPTION OF EMBODIMENTS

Figure 1:
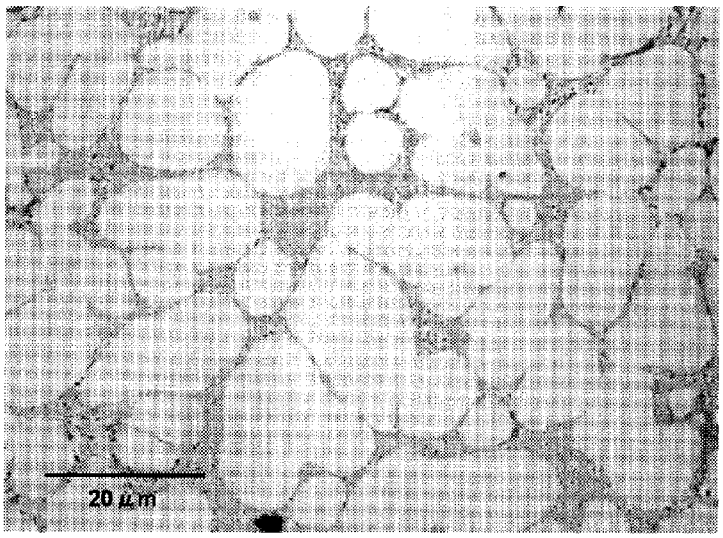
FIG. 1 is a microscope photograph showing a microstructure of an aluminum alloy casting according to Example 1-4.

Exemplary embodiments of the present invention will be described in detail below.

An aluminum alloy casting according to a first embodiment of the present invention (hereinafter referred to as a first aluminum alloy casting) consists essentially of 7.0 to 11.5 mass % of Si, 0.9 to 4.0 mass % of Mg, 0.1 to 0.65 mass % of Fe, 0.1 to 0.8 mass % of Mn and the balance being Al and unavoidable impurities and contains eutectic Si grains having an aspect ratio of 2.0 or smaller and an average grain size of 1.0 micrometer or smaller.

On the other hand, an aluminum alloy casting according to a second embodiment of the present invention (hereinafter referred to as a second aluminum alloy casting) consists essentially of 7.0 to 11.5 mass % of Si, 0.9 to 4.0 mass % of Mg, 0.1 to 0.65 mass % of Fe, 0.1 to 0.8 mass % of Mn, 0.3 to 1.0 mass % of Cu and the balance being Al and unavoidable impurities and contains eutectic Si grains having an aspect ratio of 2.0 or smaller and an average grain size of 1.0 micrometer or smaller.

Each of the first and second aluminum alloy castings can be produced by melting a raw metal material such as an aluminum alloy ingot to prepare a molten aluminum alloy of the above specific alloy element composition, injecting the molten aluminum alloy into a casting mold (also called a die) and thereby casting the molten aluminum alloy under the condition that an average flow rate of the molten aluminum alloy in the casting mold (hereinafter occasionally referred to as an average in-mold flow rate) is 12 m/s or higher.

The constituent alloy elements of the first and second aluminum alloy castings will be explained below.

Si (silicon) has a large effect of improving the die-castability of the aluminum alloy. When the Si content of the aluminum alloy is less than 7.0 mass %, the castability improvement effect of the Si element becomes small due to low flowability of the molten aluminum alloy. When the Si content of the aluminum alloy exceeds 11.5 mass %, the toughness of the resulting aluminum alloy casting becomes lowered. The Si content of each of the first and second aluminum alloy castings (the Si content of the molten aluminum alloy) is thus controlled to 7.0 to 11.5 mass %. In the case of placing an emphasis on the alloy castability, strength and toughness, it is preferable to control the Si content of each of the first and second aluminum alloy castings (the Si content of the molten aluminum alloy) to 8.0 to 10.0 mass %.

Mg (magnesium) dissolves in a base phase of the aluminum alloy and forms $Mg_2Si$ by chemical combination with Si so as to increase the strength of the aluminum alloy. When the Mg content of the aluminum alloy is less than 0.9 mass %, the strength improvement effect of the Mg element becomes small. Further, the eutectic Si grains of the aluminum alloy casting cannot be effectively reduced in size by the addition of such a small amount of Mg. The Mg element exhibits an eutectic Si grain size reduction effect when contained in an amount of 0.9 mass % or more. On the other hand, when the Mg content of the aluminum alloy exceeds 4.0 mass %, the castability and strength improvement effects of the Mg element becomes small. The 0.2% yield strength of the resulting aluminum alloy casting cannot also be improved effectively. The Mg content of each of the first and second aluminum alloy castings (the Mg content of the molten aluminum alloy) is thus controlled to 0.9 to 4.0 mass %. It is preferable to control the Mg content of each of the first and second aluminum alloy castings (the Mg content of the molten aluminum alloy) to 1.0 to 4.0 mass % in order to secure the above effects more assuredly.

Fe (iron) is effective in preventing the seizing of the aluminum alloy to the mold during the die casting process. When the Fe content of the aluminum alloy is less than 0.1 mass %, the seizing prevention effect of the Fe element becomes small. When the Fe content of the aluminum alloy exceeds 0.65 mass %, the toughness and elongation of the aluminum alloy casting become decreased with increase in the amount of an acicular Al—Fe intermetallic compound in the aluminum alloy casting. The Fe content of each of the first and second aluminum alloy castings (the Fe content of the molten aluminum alloy) is thus controlled to 0.1 to 0.65 mass %.

Mn (manganese) is also effective in preventing the seizing of the aluminum alloy to the mold during the die casting process. When the Mn content of the aluminum alloy is less than 0.1 mass %, the seizing prevention effect of the Mn element becomes small. When the Mn content of the aluminum alloy exceeds 0.8 mass %, the toughness and elongation of the aluminum alloy casting become decreased due to the formation of a coarse Al—Mn intermetallic compound or Al—Fe—Mn intermetallic compound in the aluminum alloy casting. The Mn content of each of the first and second aluminum alloy castings (the Mn content of the molten aluminum alloy) is thus controlled to 0.1 to 0.8 mass %.

Cu (copper) has an effect of further increasing the strength of the aluminum alloy. When the Cu content of the aluminum alloy is less than 0.3 mass %, the strength improvement effect of the Cu element becomes small. When the Cu content of the aluminum alloy exceeds 1.0 mass %, the toughness and corrosion resistance of the aluminum alloy casting become decreased. The Cu content of the second aluminum alloy casting is thus controlled to 0.3 to 1.0 mass %.

It is often the case that a return material is mixed in use with the casting alloy ingot for the purpose of material recycling. In consequence, some elements other than Al and the above alloy elements are contained as the unavoidable impurities in each of the first and second aluminum alloy castings.

As the unavoidable impurities of the first aluminum alloy casting, there can be exemplified Cu, P (phosphorus), Zn (zinc), Sn (tin), Pb (lead), Ni (nickel), Cr (chromium), Ti (titanium), B (boron), Zr (zirconium), Sr (strontium), Sb (antimony), Ca (calcium) and Na (sodium). Herein, the Sr, Sb, Ca and Na elements are regarded as the unavoidable impurities when the first aluminum alloy casting (molten aluminum alloy) has a Sr content of 0.003 mass % or less, a Sb content of 0.01 mass % or less, a Ca content of 0.003 mass % or less and a Na content of 0.001 mass % or less; and the Cu element is regarded as the unavoidable impurity when the first aluminum alloy casting (molten aluminum alloy) has a Cu content of 0.3 mass % or less.

As the unavoidable impurities of the second aluminum alloy casting, there can be exemplified P, Zn, Sn, Pb, Ni, Cr, Ti, B, Zr, Sr, Sb, Ca and Na. As in the case of the first aluminum alloy casting, the Sr, Sb, Ca and Na elements are regarded as the unavoidable impurities when the second aluminum alloy casting (molten aluminum alloy) has a Sr content of 0.003 mass % or less, a Sb content of 0.01 mass % or less, a Ca content of 0.003 mass % or less and a Na content of 0.001 mass % or less.

As the size reduction of the eutectic Si grains can be interfered with by the presence of P in the aluminum alloy, it is preferable that each of the first and second aluminum alloy castings (molten aluminum alloy) has a P content of 0.004 mass % or less.

It is also preferable that each of the first and second aluminum alloy castings (molten aluminum alloy) has a Ti content of 0.25 mass % or less, a Zr content of 0.25 mass % or less and a B content of 0.02 mass % or less as the addition of a large amount of Ti, Zr, B can lead to the formation of a coarse intermetallic compound and result in a deterioration of the toughness of the aluminum alloy casting.

It is further preferable that each of the first and second aluminum alloy castings (molten aluminum alloy) has a Zn content of 0.8 mass % or less, a Sn content of 0.1 mass % or less, a Pb content of 0.1 mass % or less, a Ni content of 0.1 mass % or less and a Cr content of 0.5 mass % or less in view of the practical use.

The unavoidable impurities of the aluminum alloy casting are not limited to the above elements. In the case where any element or elements other than the above impurity elements are contained as the unavoidable impurities in either of the first and second aluminum alloy castings, it is preferable to control the content of each of these other impurity elements to 0.05 mass % or less and to control the total amount of these other impurity elements to 0.5 mass % or less.

In each of the first and second aluminum alloy castings, the eutectic Si grains have an aspect ratio of 2.0 or smaller and an average grain size of 1.0 micrometer or smaller as mentioned above. The aluminum alloy casting cannot attain desired performance when the aspect ratio of the eutectic Si grains exceeds 2.0 and when the average grain size of the eutectic Si grains exceeds 1.0 micrometer. In the present invention, the aspect ratio of the eutectic Si grains is defined as the ratio of a longer dimension (length) to a shorter dimension (width) of the grains and determined by e.g. taking a microscope photograph of the metal structure of a given area of the aluminum alloy casting, observing 10 different fields of view (field view size: 0.087 mm by 0.063 mm) on the microscope photograph, calculating aspect ratios of the eutectic Si grains in the respective fields of view, and then, obtaining an average value of the calculated aspect ratios. Further, the average grain size of the eutectic Si grains is determined by e.g. taking a microscope photograph of the metal structure of a given area of the aluminum alloy casting, observing 10 different fields of view (field view size: 0.087 mm by 0.063 mm) on the microscope photograph, calculating equivalent round diameters of the eutectic Si grains in the respective fields of view by means of an image analysis device, and then, obtaining an average value of the calculated grain diameters.

Preferably, each of the first and second aluminum alloy castings can be produced by melting the raw metal material containing Al and the above alloy elements at e.g. 650 to 750 degrees Celsius and casting the molten aluminum alloy into the casting mold under the conditions of a casting pressure of 30 to 70 MPa, a molten metal injection speed of 1.0 to 4.0 m/s and a vacuum degree of 100 mbar or lower. The adoption of such high vacuum die casting process makes it possible to reduce the entry of gas into the aluminum alloy casting and the development of porosity in the aluminum alloy casting. Further, the eutectic Si grains of the aluminum alloy casting can be reduced in size and made finer effectively by controlling the average in-mold flow rate of the molten aluminum alloy to 12 m/s or higher during the vacuum die casting process.

Both of the first and second aluminum alloy castings are suitably used for automotive parts such as body flame parts, door inner parts, suspension parts etc. for which high strength and high toughness are required. The automotive part can be produced from only either of the first and second aluminum alloy castings. Alternatively, the automotive part may be produced from a combination of either the first or second aluminum alloy casting and a structural component of any other material. In the case where the material of the other structural component is stable under the casting conditions, it is conceivable to produce the automotive part by casting the aluminum alloy into the casting mold in a state that the other structural component is placed in the casting mold.

The present invention will be described below in more detail with reference to the following examples. It should be however noted that the following examples are only illustrative and are not intended to limit the invention thereto.

Test samples of Examples 1-1 to 1-4, Examples 2-1 to 2-6, Examples 3-1 to 3-3, Comparative Examples 1-1 to 1-8, Comparative Examples 2-1 to 2-6 and Comparative Examples 3-1 to 3-2 were produced and evaluated by the following procedures.

In each example, a raw metal material was molten to prepare a molten aluminum alloy having a composition of aluminum and alloy elements as shown in Table 1. The temperature of the molten aluminum alloy was controlled to 690 to 750 degrees Celsius. The molten aluminum alloy was then injected into a casting mold under the conditions of a casting pressure of 60 MPa, a molten metal injection speed of 1.6 m/s and a vacuum degree of 50 mbar or lower using a 350-t high vacuum die cast machine. With this, a plate-shaped aluminum alloy casting of 110 mm length, 110 mm width and 3.5 mm or 5 mm thickness was obtained. Herein, the Sr, Na, Ca and Sb contents of the aluminum alloy casting were less than 0.001 mass %, less than 0.0005 mass %, 0.001 mass % and less than 0.001 mass %, respectively, in each example. Further, the average in-mold flow rate of the molten aluminum alloy was determined according to the following equation.

$$\text{Average In-Mold Flow Rate(m/s)} = \frac{[\text{Injection Speed(m/s)}] \times [\text{Sleeve Cross Section Area(mm}^2)]}{[\text{Product Cross Section Area(mm}^2)]} \quad \text{Equation 1}$$

The produced aluminum alloy casting was used, as it was, as the test sample. Thus, the heat code of the test sample was F according to JIS H 0001.

The microstructure of each of the aluminum alloy castings was observed with a microscope to examine the size reduction of eutectic Si grains of the aluminum alloy casting. Herein, the observation of the eutectic Si grains was made at a center, large-thickness portion of the aluminum alloy casting. The aspect ratio and average grain size of the eutectic Si grains were determined based on the microscope observation results. It was judged that the size reduction of the eutectic Si grains occurred when the eutectic Si grains were smaller than or equal to 1 micrometer in size and that the size reduction of the eutectic Si grains did not occurred when the eutectic Si grains were greater than 1 micrometer in size.

The compositions of the aluminum alloy castings, the average in-mold flow rates of the molten aluminum alloys and the aspect ratios and average grain sizes of the eutectic Si grains of Examples 1-1 to 1-4, 2-1 to 2-6 and 3-1 to 3-3 and Comparative Examples 1-1 to 1-8, 2-1 to 2-6 and 3-1 to 3-2 are indicated in Tables 1 and 2. In Table 2, the circle indicates the occurrence of size reduction of the eutectic Si grains; and the cross indicates the non-occurrence of size reduction of the eutectic Si grains.

TABLE 1

| | Alloy element (mass %) | | | | | |
|---|---|---|---|---|---|---|
| | Si | Mg | Fe | Mn | Cu | Remarks |
| Example 1-1 | 9.6 | 1.05 | 0.41 | 0.42 | <0.01 | |
| Example 1-2 | 9.8 | 1.41 | 0.41 | 0.44 | <0.01 | |
| Example 1-3 | 9.6 | 0.90 | 0.41 | 0.38 | <0.01 | |
| Example 1-4 | 9.8 | 1.74 | 0.41 | 0.44 | <0.01 | |
| Comparative Example 1-1 | 9.6 | 0.39 | 0.41 | 0.4 | <0.01 | |
| Comparative Example 1-2 | 9.6 | 0.45 | 0.41 | 0.4 | <0.01 | |
| Comparative Example 1-3 | 9.5 | 0.73 | 0.42 | 0.4 | <0.01 | |
| Comparative Example 1-4 | 9.5 | 0.7 | 0.39 | 0.4 | <0.01 | |
| Comparative Example 1-5 | 9.5 | 0.92 | 0.39 | 0.42 | <0.01 | |
| Comparative Example 1-6 | 9.6 | 1.21 | 0.4 | 0.42 | <0.01 | |
| Comparative Example 1-7 | 9.6 | 1.62 | 0.39 | 0.42 | <0.01 | |
| Comparative Example 1-8 | 9.6 | 1.95 | 0.4 | 0.43 | <0.01 | |
| Example 2-1 | 7.3 | 1.43 | 0.56 | 0.55 | <0.01 | |
| Example 2-2 | 8.3 | 1.5 | 0.35 | 0.35 | <0.01 | |
| Example 2-3 | 11.1 | 1.05 | 0.29 | 0.35 | <0.01 | |
| Example 2-4 | 8.1 | 3.6 | 0.34 | 0.33 | <0.01 | |
| Example 2-5 | 9.7 | 1.10 | 0.18 | 0.78 | <0.01 | |
| Example 2-6 | 9.8 | 1.09 | 0.64 | 0.18 | <0.01 | |
| Comparative Example 2-1 | 7.2 | 0.4 | 0.52 | 0.53 | <0.01 | |
| Comparative Example 2-2 | 7.2 | 1.44 | 0.56 | 0.55 | <0.01 | |
| Comparative Example 2-3 | 11.7 | 0.85 | 0.61 | 0.65 | <0.01 | |
| Comparative Example 2-4 | 6.5 | 1.41 | 0.58 | 0.56 | <0.01 | |

TABLE 1-continued

| | Alloy element (mass %) | | | | | |
|---|---|---|---|---|---|---|
| | Si | Mg | Fe | Mn | Cu | Remarks |
| Comparative Example 2-5 | 9.8 | 4.5 | 0.35 | 0.36 | <0.01 | |
| Comparative Example 2-6 | 9.9 | 1.14 | 0.87 | 0.86 | <0.01 | |
| Example 3-1 | 9.5 | 1.11 | 0.36 | 0.36 | 0.4 | Cu-containing samples |
| Example 3-2 | 9.6 | 1.13 | 0.45 | 0.45 | 0.9 | |
| Example 3-3 | 8.5 | 3.2 | 0.32 | 0.32 | 0.5 | |
| Comparative Example 3-1 | 9.8 | 1.19 | 0.46 | 0.49 | 0.9 | |
| Comparative Example 3-2 | 8.5 | 3.3 | 0.32 | 0.32 | 0.5 | |

TABLE 2

| | | Eutectic Si grains | | |
|---|---|---|---|---|
| | Average in-mold flow rate (m/s) | Aspect ratio | Average grain size (μm) | Grain size reduction |
| Example 1-1 | 12.2 | 1.3 | 0.7 | ○ |
| Example 1-2 | 12.1 | 1.2 | 0.65 | ○ |
| Example 1-3 | 12.0 | 1.4 | 0.63 | ○ |
| Example 1-4 | 12.1 | 1.5 | 0.55 | ○ |
| Comparative Example 1-1 | 11.9 | 5.3 | 4.2 | X |
| Comparative Example 1-2 | 11.8 | 4.8 | 3.5 | X |
| Comparative Example 1-3 | 12.0 | 3.9 | 2.8 | X |
| Comparative Example 1-4 | 8.2 | 6.3 | 7.3 | X |
| Comparative Example 1-5 | 8.2 | 5.3 | 6.2 | X |
| Comparative Example 1-6 | 8.0 | 5.9 | 6.8 | X |
| Comparative Example 1-7 | 8.1 | 4.8 | 5.5 | X |
| Comparative Example 1-8 | 7.9 | 4.9 | 6.2 | X |
| Example 2-1 | 12.1 | 1.2 | 0.60 | ○ |
| Example 2-2 | 12.2 | 1.4 | 0.65 | ○ |
| Example 2-3 | 12.5 | 1.7 | 0.85 | ○ |
| Example 2-4 | 12.2 | 1.4 | 0.66 | ○ |
| Example 2-5 | 12.2 | 1.4 | 0.71 | ○ |
| Example 2-6 | 12.2 | 1.5 | 0.72 | ○ |
| Comparative Example 2-1 | 12.0 | 3.6 | 2.5 | X |
| Comparative Example 2-2 | 7.8 | 4.0 | 2.8 | X |
| Comparative Example 2-3 | 12.4 | 5.8 | 4.0 | X |
| Comparative Example 2-4 | 12.0 | 1.2 | 0.61 | ○ |
| Comparative Example 2-5 | 12.3 | 1.8 | 0.91 | ○ |
| Comparative Example 2-6 | 12.1 | 1.6 | 0.75 | ○ |
| Example 3-1 | 12.0 | 1.3 | 0.67 | ○ |
| Example 3-2 | 12.1 | 1.4 | 0.69 | ○ |
| Example 3-3 | 12.2 | 1.4 | 0.68 | ○ |
| Comparative Example 3-1 | 8.3 | 5.4 | 6.0 | X |
| Comparative Example 3-2 | 7.7 | 3.8 | 3.5 | X |

Further, the aluminum alloy castings were machined into No. 14B test pieces according to JIS Z 2201. Each of the test pieces was subjected to tensile test according to JIS Z 2241 to measure the tensile strength, 0.2% yield strength and elongation at breakage of the aluminum alloy casting. More specifically, the tensile strength was determined from the load at breakage and the original cross section area of the parallel portion of the test piece. The 0.2% yield strength was determined from the stress at 0.2% strain and the cross section area of the test piece, by measuring the stress at 0.2% strain using an extensometer with reference to a stress-strain curve. Further, the elongation at breakage was determined by a so-called butt method with a gauge length of 40 mm. (The butt method is a method for determining an elongation at breakage of the sample based on a distance between two gauge marks previously set on the sample before the test and a distance between the two gauge marks measured by placing broken ends of the sample back together after the test.)

The tensile test results of Examples 1-1 to 1-4, 2-1 to 2-6 and 3-1 to 3-3 and Comparative Examples 1-1 to 1-8, 2-1 to 2-6 and 3-1 to 3-2 are indicated in Table 3.

TABLE 3

| | Mechanical properties | | |
|---|---|---|---|
| | Tensile strength (MPa) | 0.2% Yield stress (MPa) | Elongation (%) |
| Example 1-1 | 330 | 196 | 8 |
| Example 1-2 | 335 | 201 | 7.2 |
| Example 1-3 | 329 | 190 | 8.3 |
| Example 1-4 | 339 | 208 | 6.8 |
| Comparative Example 1-1 | 291 | 150 | 11 |
| Comparative Example 1-2 | 295 | 157 | 10.5 |
| Comparative Example 1-3 | 311 | 174 | 8.7 |
| Comparative Example 1-4 | 303 | 162 | 5.6 |
| Comparative Example 1-5 | 313 | 170 | 5.7 |
| Comparative Example 1-6 | 312 | 184 | 3.8 |
| Comparative Example 1-7 | 331 | 197 | 3.2 |
| Comparative Example 1-8 | 319 | 203 | 2.8 |
| Example 2-1 | 322 | 190 | 8.9 |
| Example 2-2 | 330 | 195 | 8.1 |
| Example 2-3 | 332 | 203 | 6.2 |
| Example 2-4 | 342 | 240 | 5.3 |
| Example 2-5 | 328 | 198 | 7.2 |
| Example 2-6 | 325 | 197 | 6.8 |
| Comparative Example 2-1 | 285 | 126 | 13.3 |
| Comparative Example 2-2 | 301 | 170 | 6.1 |
| Comparative Example 2-3 | 315 | 185 | 3.2 |
| Comparative Example 2-4 | 310 | 176 | 7.8 |
| Comparative Example 2-5 | 335 | 237 | 2.8 |
| Comparative Example 2-6 | 313 | 199 | 3.0 |
| Example 3-1 | 335 | 201 | 7.5 |
| Example 3-2 | 340 | 215 | 6.7 |
| Example 3-3 | 343 | 238 | 5.4 |
| Comparative Example 3-1 | 333 | 199 | 3.8 |
| Comparative Example 3-2 | 334 | 226 | 2.6 |

FIG. 1 shows a microscope photograph of the aluminum alloy casting of Example 1-4. As seen from FIG. 1, the eutectic Si grains of the aluminum alloy casting of Example 1-4 had a very fine microstructure similar to those in which eutectic modifying elements such as Sr were added. Although not specifically shown, the eutectic Si grains of the aluminum alloy castings of Examples 1-1 to 1-3, 2-1 to 2-6 and 3-1 to 3-3 also had very fine microstructures as in the case of Example 1-4. In each of Examples 1-1 to 1-4, 2-1 to 2-6 and 3-1 to 3-3, the eutectic Si grains were reduced in size and made finer to a very small average grain size of 0.55 to 0.85 micrometer whereby the aluminum alloy casting had a metal structure of high strength and high toughness.

Figure 2:
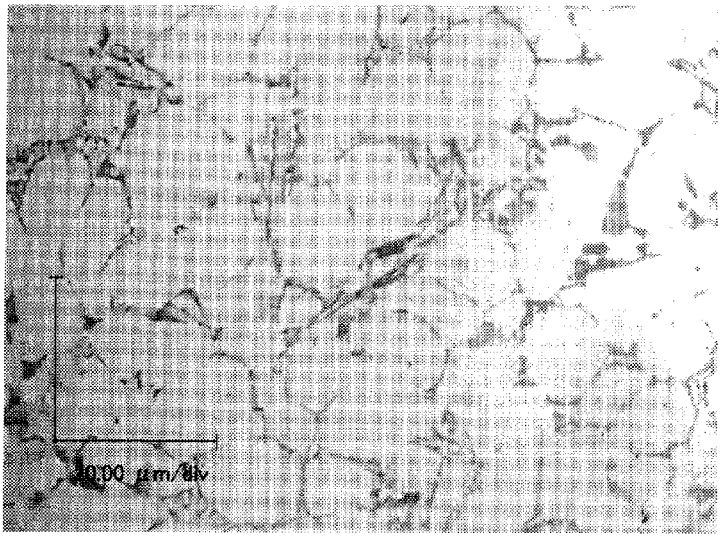
FIG. 2 is a microscope photograph showing a microstructure of an aluminum alloy casting according to Comparative Example 1-3.

FIG. 2 shows a microscope photograph of the aluminum alloy casting of Comparative Example 1-3. As seen from FIG. 2, the eutectic Si grains of the aluminum alloy casting of Comparative Example 1-3 had a common acicular structure. Similarly, the eutectic Si grains of the aluminum alloy castings of Comparative Examples of 1-1 to 1-2, 1-4 to 1-8, 2-1 to 2-6 and 3-1 to 3-2 had common acicular structures. In Comparative Examples of 1-1 to 1-8, 2-1 to 2-6 and 3-1 to 3-2, the eutectic Si grains had a large average grain size of 2.5 to 7.3 micrometers and were not reduced in size and made finer so that the toughness and ductility of the aluminum alloy castings were lower than those of Examples 1-1 to 1-4, 2-1 to 2-6 and 3-1 to 3-3. In Comparative Example 2-4, the 0.2% yield strength of the aluminum alloy casting was low because of the low Si content of less than 7.0 mass % even though the eutectic Si grains had a very small average grain size of 0.61 micrometer. In Comparative Example 2-5, the ductility of the aluminum alloy casting was low because of the high Mg content exceeding 4.0 mass % even though the eutectic Si grains had a very small average grain size of 0.91 micrometer. In comparative Example 2-6, the ductility of the aluminum alloy casting was low because of the high Fe content exceeding 0.65 mass % and the high Mn content exceeding 0.8 mass % even though the eutectic Si grains had a very small average grain size of 0.75 micrometer.

Accordingly, the aluminum alloy castings of Examples 1-1 to 1-4, 2-1 to 2-6 and 3-1 to 3-3 showed more improvements in toughness and ductility as compared to those of Comparative Examples of 1-1 to 1-8, 2-1 to 2-6 and 3-1 to 3-2 as shown in Table 3.

Figure 3:
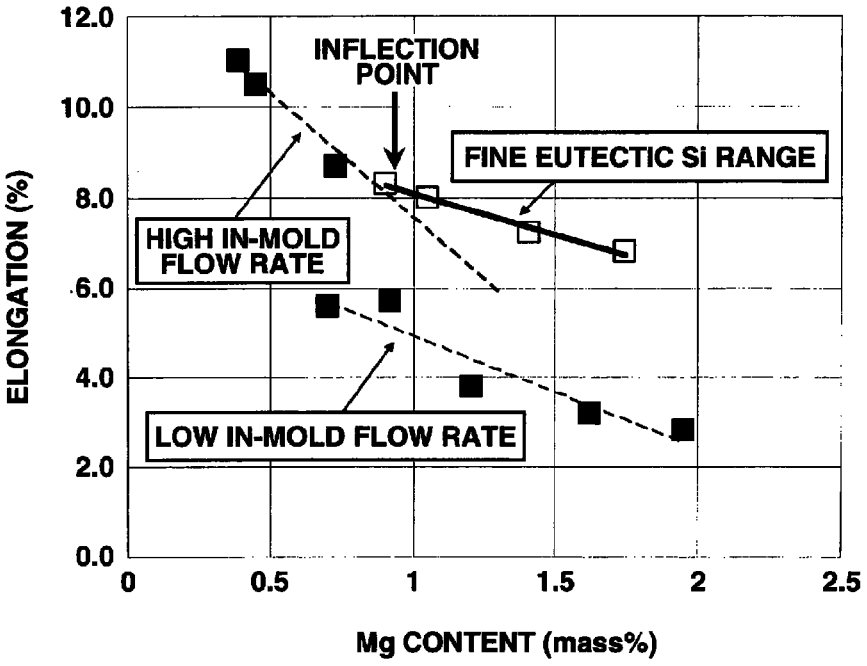
FIG. 3 is a graph showing a correlation between the Mg content and elongation of the aluminum alloy casting.

FIG. 3 shows a relationship of the Mg content and static tensile elongation of the aluminum alloy casting based on the test results of Examples 1-1 to 1-4 and Comparative Examples 1-1 to 1-8. In Comparative Examples 1-4 to 1-8 where the average in-mold flow rate of the molten aluminum alloy was low, the aluminum alloy castings had a low elongation of less than 6% and showed a tendency of decrease in the elongation with increasing the Mg content. This is assumed to be because the elongation of the aluminum alloy casting decreased with increase in aluminum alloy strength due to the formation of $Mg_2Si$ by chemical combination of undissolved Mg and Si and the strengthening of the Al base phase by dissolution of Mg in Al. In Examples 1-1 to 1-4 and Comparative Examples 1-1 to 1-3 where the average in-mold flow rate of the molten aluminum alloy was high, the aluminum alloy castings had a higher elongation and also showed a tendency of decrease in the elongation with increasing the Mg content. However, there was a point of inflection at a Mg content of 0.9 mass %. In the fine eutectic Si range where the Mg content was higher than or equal to 0.9 mass %, the amount of decrease of the elongation was reduced. This is assumed to be because the elongation of the aluminum alloy casting increased as the development of a crack in the aluminum alloy casting at the breakage was retarded due to the size reduction of the eutectic Si grains.

Figure 4:
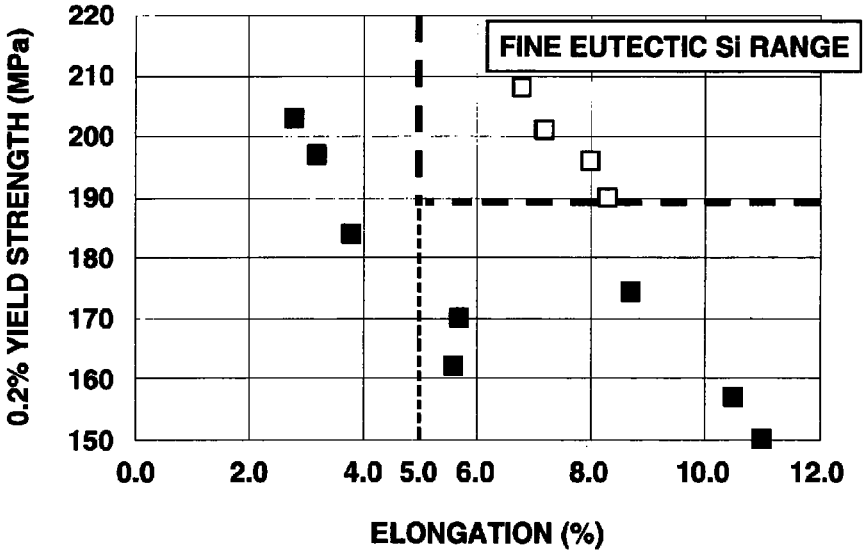
FIG. 4 is a graph showing a correlation between the elongation and 0.2% yield strength of the aluminum alloy casting.

FIG. 4 shows a relationship of the elongation and 0.2% yield strength of the aluminum alloy casting based on the test results of Examples 1-1 to 1-4 and Comparative Examples 1-1 to 1-8. The aluminum alloy castings of Examples 1-1 to 1-4 where the eutectic Si grains were reduced in size and made finer had a good balance of 0.2% yield strength and ductility as compared to those of Comparative Examples 1-1 to 1-8 where the eutectic Si grains were not reduced in size and made finer. Each of the aluminum alloy castings of Examples 1-1 to 1-4 achieved a 0.2% yield strength of 190 MPa or higher and an elongation of 5.0% or higher required for use in automotive parts.

It has thus been shown that the aluminum alloy castings of Examples 1-1 to 1-4, 2-1 to 2-6 and 3-1 to 3-3 had excellent mechanical properties such as high strength and high toughness.

As described above, it is possible according to the present invention to produce the aluminum alloy casting with achieve excellent mechanical properties, without adding thereto an expensive eutectic modifying element, by casting the molten aluminum alloy of predetermined alloy composition under predetermined conditions.

Although the present invention has been described with reference to the specific embodiments, the invention is not limited to the above-described embodiments. Various modification and variation of the embodiments described above will occur to those skilled in the art in light of the above teaching. The scope of the invention is defined with reference to the following claims.

The invention claimed is:

1. An aluminum alloy cast member consisting essentially of 7.0 to 11.5 mass % of Si, 0.9 to 4.0 mass % of Mg, 0.1 to 0.65 mass % of Fe, 0.1 to 0.8 mass % of Mn and the balance being Al and unavoidable impurities and containing eutectic Si grains having an aspect ratio of 2.0 or smaller and an average grain size of 1.0 micrometer or smaller.

2. An aluminum alloy cast member consisting essentially of 7.0 to 11.5 mass % of Si, 0.9 to 4.0 mass % of Mg, 0.1 to 0.65 mass % of Fe, 0.1 to 0.8 mass % of Mn, 0.3 to 1.0 mass % of Cu and the balance being Al and unavoidable impurities and containing eutectic Si grains having an aspect ratio of 2.0 or smaller and an average grain size of 1.0 micrometer or smaller.

3. An aluminum alloy cast member according to claim 1, wherein the content of said Si is 8.0 to 10.0 mass %; and the content of said Mg is 1.0 to 4.0 mass %.

4. An automotive part comprising an aluminum alloy casting according to claim 1.

5. A method of producing an aluminum alloy casting according to claim 1, comprising: preparing a molten aluminum alloy consisting essentially of 7.0 to 11.5 mass % of Si, 0.9 to 4.0 mass % of Mg, 0.1 to 0.65 mass % of Fe, 0.1 to 0.8 mass % of Mn and the balance being Al and unavoidable impurities; and injecting the molten aluminum alloy into a casting mold to thereby cast the molten aluminum alloy under the condition that an average flow rate of the molten aluminum alloy in the casting mold is 12 m/s or higher.

6. An aluminum alloy cast member according to claim 2, wherein the content of said Si is 8.0 to 10.0 mass %; and the content of said Mg is 1.0 to 4.0 mass %.

7. An automotive part comprising an aluminum alloy casting according to claim 2.

8. A method of producing an aluminum alloy casting according to claim 2, comprising: preparing a molten aluminum alloy consisting essentially of 7.0 to 11.5 mass % of Si, 0.9 to 4.0 mass % of Mg, 0.1 to 0.65 mass % of Fe, 0.1 to 0.8 mass % of Mn, 0.3 to 1.0 mass % of Cu and the balance being Al and unavoidable impurities; and injecting the molten aluminum alloy into a casting mold to thereby cast the molten aluminum alloy under the condition that an average flow rate of the molten aluminum alloy in the casting mold is 12 m/s or higher.

* * * * *